US005176066A

United States Patent [19]

Kanamaru et al.

[11] Patent Number: 5,176,066

[45] Date of Patent: Jan. 5, 1993

[54] AXIAL PISTON PUMP APPARATUS WITH AN IMPROVED DRIVE MECHANISM

[75] Inventors: Hisanobu Kanamaru; Kouji Harada, both of Katsuta, Japan

[73] Assignee: Hitachi, Ltd., Tokyo, Japan

[21] Appl. No.: 654,688

[22] Filed: Feb. 13, 1991

[30] Foreign Application Priority Data

Feb. 19, 1990 [JP] Japan ..... 2-36070

[51] Int. Cl.[5] ..... F01B 13/04; F04B 1/30

[52] U.S. Cl. ..... 91/499; 417/269; 92/57

[58] Field of Search ..... 417/269, 222; 91/499; 92/57, 71, 240

[56] References Cited

U.S. PATENT DOCUMENTS

| | | | |
|---|---|---|---|
| 4,617,853 | 10/1986 | Wagenseil | 417/222 |
| 4,771,676 | 9/1988 | Matsumoto | 91/499 |
| 4,776,257 | 10/1988 | Hansen | 91/499 |
| 4,788,902 | 12/1988 | Akasaha | 92/57 |
| 4,884,952 | 12/1989 | Kanamaru et al. | 417/222 |
| 4,894,045 | 1/1990 | Kanamaru et al. | 464/138 |
| 5,011,377 | 4/1991 | Sagawa | 417/269 |

FOREIGN PATENT DOCUMENTS

| | | |
|---|---|---|
| 59-5794 | 3/1984 | Japan . |
| 63-309785 | 12/1988 | Japan . |
| 64-12079 | 1/1989 | Japan . |

*Primary Examiner*—Richard A. Bertsch

*Assistant Examiner*—Peter Korytnyk

*Attorney, Agent, or Firm*—Antonelli, Terry, Stout & Kraus

[57] ABSTRACT

An axial piston pump apparatus includes a rotary cylinder barrel with plural cylinder bores in each of which a slidable piston is arranged. Each piston is rotatably held at one end with a piston support synchronously rotatable with the cylinder barrel. The piston support rotates in a plane inclined to the cylinder barrel, while each piston reciprocally moves in the corresponding cylinder bore to perform suction/discharging of a fluid. Two of the pistons come into surface contact with the corresponding cylinder bores; and the end of these pistons are held respectively in the piston support for radial movement to serve as drive pins for transmitting torque between the cylinder barrel and the piston support. During operation of the pump apparatus, the one end of each drive piston radially moves in accordance with rotation of the piston support, thereby preventing the drive pistons from inclining to the corresponding cylinder bores and appropriately maintaining surface contact between them. Thus, the two of the pistons serve as drive pins. This obviates the necessity of any separate drive mechanism and hence enables the reduction in size of the pump. Moreover, the drive pistons are kept is surface contact with the cylinder bores without impinging thereon thereby reducing noise and vibration of the pump apparatus.

13 Claims, 4 Drawing Sheets

R1---PITCH RADIUS OF PISTON SPHERICAL HEAD

R2---CYLINDER BORE PITCH RADIUS

AXIAL PISTON PUMP APPARATUS WITH AN IMPROVED DRIVE MECHANISM

BACKGROUND OF THE INVENTION

The present invention relates to an axial piston pump apparatus, and particularly relates to an improvement in a drive mechanism for driving a cylinder barrel or a swash plate of the same apparatus.

An axial piston pump has a structure wherein plural pistons are arranged in parallel with an axis of a rotary cylinder barrel, and one end of each piston is pivotally supported on a drive shaft or a swash plate which is inclined to the cylinder barrel. The pistons are reciprocally moved in respective cylinder bores provided in the cylinder barrel as the cylinder barrel is rotated, and thereby perform suction and discharge.

The axial piston pump with such a structure is disclosed in Japanese Patent Examined Publication No. 59-5794, for example. In the axial piston pump taught in this publication, all the pistons serve as drive pins to transmit torque to the cylinder barrel as well as carry out suction and discharge.

In contrast to the axial piston pump of this publication, the inventors have proposed an axial piston pump structure in which drive pins are provided to transmit turning force or torque separately from the pistons. This axial piston pump is disclosed in Japanese Patent Unexamined Publications Nos. 63-309785, 64-12079 and 1-77771, the last publication of which corresponds to U.S. Pat. No. 4,884,952 issued on Dec. 5, 1990.

As described in detail later, it is however necessary to improve further the drive mechanism of the axial piston pump in view of reduction in noise, vibration and size.

SUMMARY OF THE INVENTION

It is an object of the present invention to provide an axial piston pump apparatus which is simple in structure and makes less noise and vibration.

It is another object of the invention to provide a high pressure type axial piston pump apparatus which is capable of achieving reduction in size and noise.

It is still another object of the invention to provide a low pressure type axial piston pump apparatus which is capable of achieving reduction in size and noise.

To accomplish these and other objects, in the axial piston pump apparatus of the invention, a pair of pistons thereof is adapted to function as drive pins.

According to one aspect of the invention, there is provided an axial piston pump apparatus which comprises a drive shaft, a cylinder barrel rotatably arranged and having a plurality of cylinder bores formed therein around and in parallel with an axis of rotation thereof, a means for connecting the drive shaft to the cylinder barrel to rotate the cylinder barrel synchronously with the drive shaft, pistons slidably arranged within the respective cylinder bores, and a piston support means mounted on the drive shaft for pivotally supporting one end of each piston so that the one end of each piston rotates synchronously with the cylinder barrel in a plane inclined to the cylinder barrel. Two of the pistons are provided to be in surface contact with corresponding cylinder bores to serve as drive pins for transmitting torque between the cylinder barrel and the piston support means.

In an example of applying the invention to a high pressure type axial piston pump apparatus, the drive shaft is arranged to incline to the rotary axis of the cylinder barrel, the piston support means is coaxially and integrally formed with one end of the drive shaft, and the two pistons transmit driving force for rotation or torque from the piston support means to the cylinder barrel to serve as the synchronous rotation means. The drive shaft is provided for swinging movement to be variable in an inclination angle to the rotary axis of the cylinder barrel.

Further, in an example of applying the invention to a low pressure type axial piston pump apparatus, the cylinder barrel is coaxially and slidably mounted on the drive shaft to receive the torque from the drive shaft through the connection means and rotate together with the drive shaft, the piston support means is rotatably and pivotably mounted on the drive shaft through a spherical bearing, and the two pistons transmit the torque from the cylinder barrel to the piston support means to thereby rotate the piston support means synchronously with the cylinder barrel. The piston support means is inclined to the cylinder barrel through its contact with a swash plate which has a surface inclined at a predetermined angle.

In the axial piston pump apparatus above described of the invention, the two drive pistons perform only sliding movements in corresponding cylinder bores with surface contacts to the latter. On the other hand, each of the other pistons makes precession while sliding within the corresponding cylinder bore and pivoting at the one end thereof in the piston support. The drive pistons are provided with the ordinary piston function, and hence a necessary number of effective cylinders for a predetermined discharge is secured. These drive pistons also have the function of the conventional drive pins, and thus it is not necessary to provide a separate drive mechanism. Moreover, there occurs no impingement at, as well as contact portions between the pistons and the corresponding cylinder bores, contact portions between the drive pistons and the respective cylinder bores, and thus no mechanical vibration due to such impingement is produced.

According to the invention, some of the pistons are formed to be in surface contact with corresponding cylinder bores to also serve as drive pins for the cylinder barrel or the piston support. Thus, the axial piston pump apparatus can be reduced in size and noise.

A pair of pistons which are arranged symmetrically about the axis of the cylinder barrel may be used as drive pins. In this case, transmission of driving forces can be smoothed further.

DETAILED DESCRIPTION OF THE PREFERRED EMBODIMENTS

At the outset, for providing a clear understanding of the invention, problems of conventional axial piston pumps will be described. The analysis of the following problems was done by the present inventors, and constitutes the basis of the invention.

In the conventional axial piston pumps already discussed above, synchronous driving of the cylinder barrel or the swash plate by the drive shaft is carried out in either one of two ways. More particularly, the synchronous driving is performed through all the pistons or through drive pins provided separately from the pistons.

Figure 5:
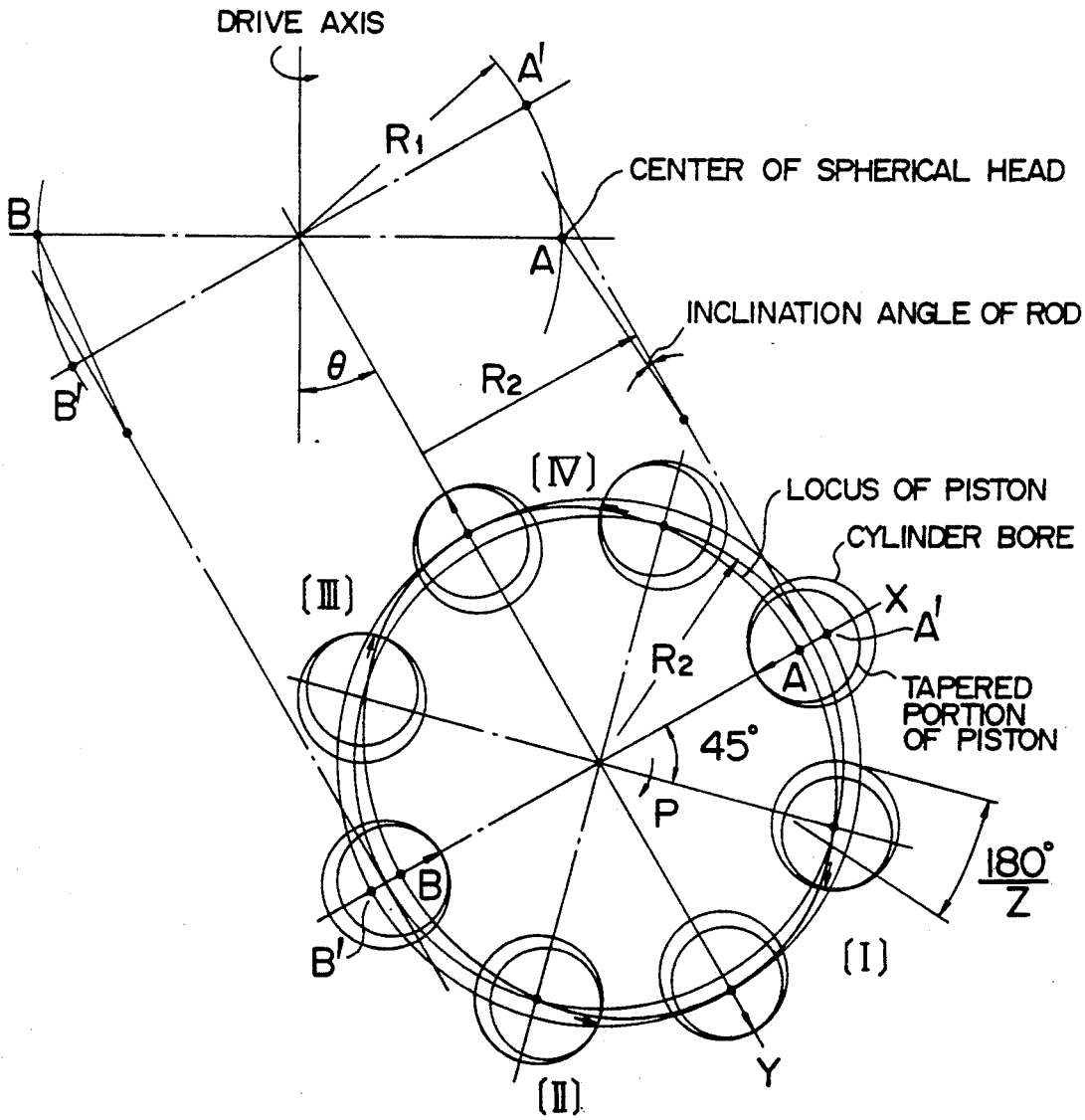
FIG. 5 is a diagram illustrating loci of pistons of an axial piston pump apparatus, on the analysis of which the present invention is based.

According to the former, each piston is designed to perform two functions, i.e., suction/discharge, which is the primary function thereof, and transmission of driving force for rotation or torque. Generally in an axial piston pump, however, one end of each piston rotates in an inclined plane, and hence the pistons and corresponding cylinder bores are not completely in axial alignment. As shown in FIG. 5, therefore, each piston in fact draws a locus of an ellipse during the rotation of the cylinder barrel, and this locus disagrees with a circular locus of the corresponding cylinder bore. More specifically, according as the cylinder barrel is rotating, each piston moves in a substantially precessional motion manner with respect to the corresponding cylinder bore, and the pistons are brought into contact with walls of the respective cylinder bores at positions shown by arrows in FIG. 5. In this state, positions where the pistons drive the cylinder barrel, that is, the pistons can transmit turning force to the cylinder barrel are positions where the pistons precede corresponding cylinder bores in the rotational direction P of the cylinder barrel. In FIG. 5, these positions are central portions of quadrants I and III in x-y coordinate Thus, the transmission of torque is achieved around 45° of these quadrants, and in the case of a pump with an odd number Z of cylinder bores, the quadrants I and III change alternately for a range of 180°/Z.

To cope with such a phenomenon, the axial piston pump, proposed in Japanese Patent Examined Publication No. 59(1984)-5794, is provided with pistons all of which have heads or shanks formed in a cylindrical shape for transmitting driving force. Each of the cylindrical heads or shanks has an outer surface axially curved to reduce contact thereof with the wall of the corresponding cylinder bore in a biased manner. As described, however, the transmission of driving force due to the contact between the pistons and the walls of the cylinder bores is performed only at the predetermined rotational positions. Moreover, movements of the pistons are dynamically uneven. As a result, there is a possibility that the drive pistons impinge upon the walls of the respective cylinder bores, when moving in the manner described above, so that excessive forces act on the pistons or mechanical vibration of the pump increases. Furthermore, such impingement would provide damages to the walls of the cylinder bores and pistons, thus causing the sealing of them to become difficult.

On the other hand, according to the latter of the above two ways, the pistons can sufficiently fulfill their own suction/discharge function while transmission of torque is securely achieved by the separate drive pins. However, the provision of the separate torque transmission mechanism makes the structure of the pump rather complicated. This results in that the pump apparatus becomes large-sized and is hence not suitable for purpose of reduction in size and cost.

The present invention has been accomplished in view of the above problems of the conventional axial piston pumps.

The invention will be described hereinafter on the bases of embodiments there of with reference to FIGS. 1 to 4.

Figure 1:
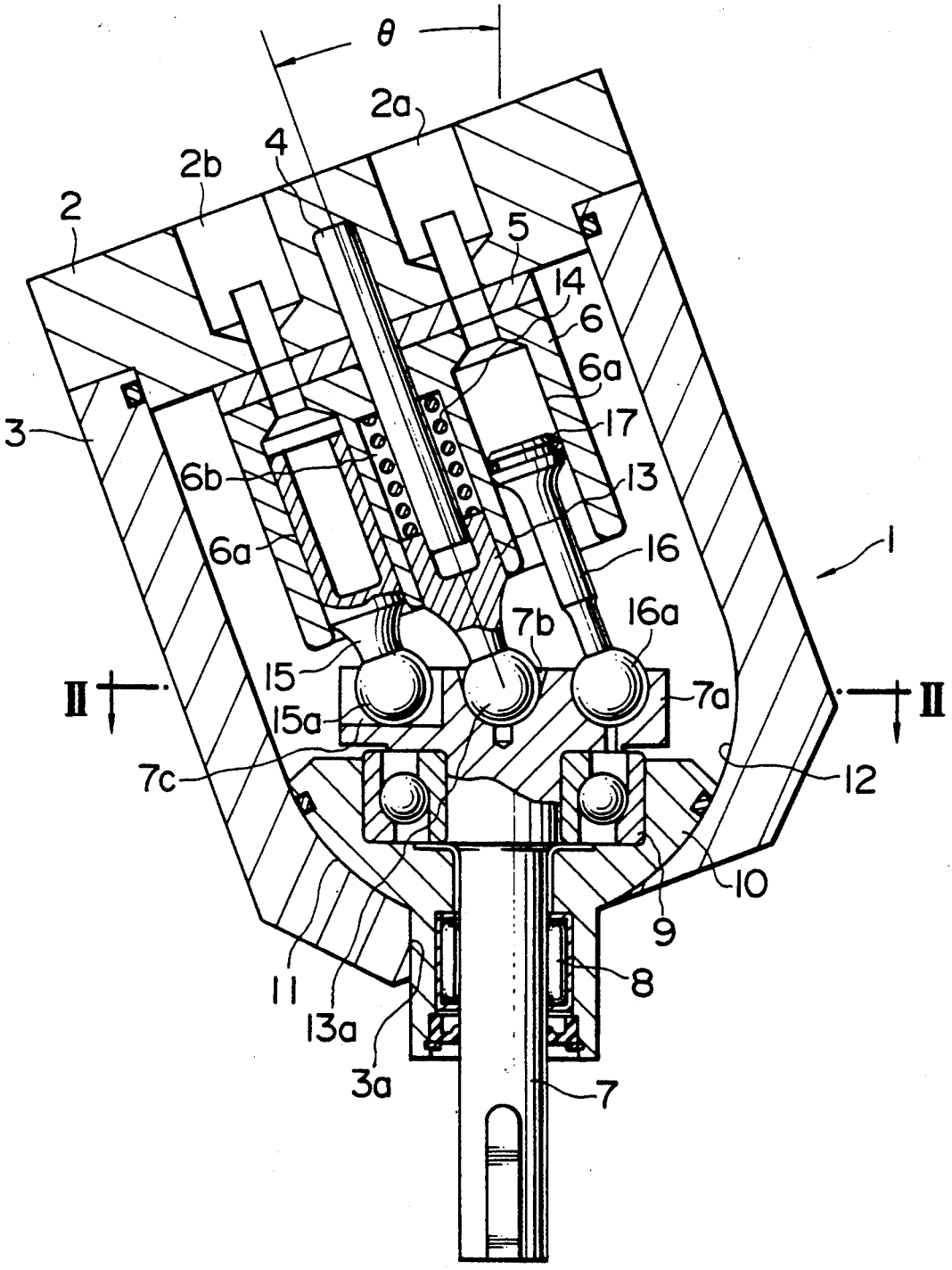
FIG. 1 is a longitudinal sectional view of a bent axis type axial piston pump apparatus according to an embodiment of the invention.

Referring to FIG. 1, a bent axis type axial piston pump according to the first embodiment of the invention has a casing 1. The casing 1 is composed of a substantially cup-shaped housing 3 and an end cover 2 hermetically closing an open end of the housing 3. The end cover 2 has a suction hole 2*a* and a discharge hole 2*b* formed through the cover, and these holes communicate to the interior of the casing. A first cylinder pin 4 is vertically fixed to the central portion of the inner surface of the end cover 2 to extend into the casing 1. A cylinder barrel 6 is rotatably supported on the first cylinder pin 4 through a valve plate 5.

The cylinder barrel 6 is in the shape of a cylinder and has a cylinder pin insertion hole 6*b* concentrically perforated in it. The cylinder barrel 6 is further formed with a plurality of, six in the illustrated embodiment, cylinder bores 6*a*. These cylinder bores are arranged in parallel with the cylinder pin insertion hole 6*b* and at regular angular intervals about this cylinder pin insertion hole. Each of the cylinder bores 6*a* opens at one end of the barrel on the side of the valve plate 5 through a small through hole. On the other hand, the valve plate 5 is attached to the end cover 2 and is provided with through holes which communicate to the suction hole 2*a* and the discharge hole 2*b*, respectively. Thus, each of the cylinder bores 6*a* communicates to the suction hole 2*a* or the discharge hole 2*b* through the valve plate 5 according as the cylinder barrel 6 rotates.

A drive shaft 7 is disposed on the side of the bottom of the casing 1, or the opposite side of the casing to the end cover 2. A disk-shaped piston support 7*a* is integrally and concentrically formed with an upper end of the drive shaft 7. The casing 1 has a inner bottom surface 12 which is formed in a semi-spherical shape and is provided with a through hole at a position offset from its center axis. The drive shaft 7 extends into the casing 1 through this through hole, and is inclined to the axis of rotation of the cylinder barrel 6 at an angle of $\theta$ as shown in FIG. 1.

To angularly movably and rotatably support the drive shaft 7, a semi-spherical slide block 10 is interposed between the drive shaft 7 and the bottom of the casing 1. The slide block 10 has an outer circumferential surface 11 which is complementary to the inner bottom surface 12 of the casing 1. The slide block 10 is provided at its lower portion with a projection which extends through the through hole in the bottom of the casing 1. The slide block 10 rotatably supports the drive shaft 7 by means of a needle bearing 8 and a roller bearing 9. Thus, the drive shaft 7 is rotatable with respect to the casing 1 and is swingable to the same through the sliding of the slide block 10 on the inner bottom surface 12.

Disposed between the cylinder barrel 6 and the drive shaft 7 is a second cylinder pin 13 which is slidably inserted, together with a compression spring 14, into the cylinder pin insertion hole 6*b*. The cylinder pin 13 has an end projecting out of the cylinder barrel 6, on which end a spherical head 13*a* is formed. The piston support 7a of the drive shaft 7 is formed at its central portion with a recess 7b for rotatably receiving the spherical head 13a. The spherical head 13a of the cylinder pin is always kept by a spring force of the compression spring 14 in abutment against the recess 7b and, at the same time, the cylinder barrel 6 is urged to the valve plate 5.

Two types of pistons are slidably inserted into the respective cylinder bores 6a of the cylinder barrel 6. Reference numeral 15 designates a pair of drive pistons which are respectively arranged in the cylinder hole 6a at opposite positions with the cylinder pin 13 interposed therebetween. Each of the drive pistons 15 has a substantially cylindrical shank portion and a lower end, which projects from the corresponding cylinder bore 6a and is formed with a spherical head 15a. The piston support 7a of the drive shaft 7 is provided at corresponding positions thereof to these drive pistons with a pair of slide grooves 7c for holding the respective spherical heads 15a.

Figure 2:
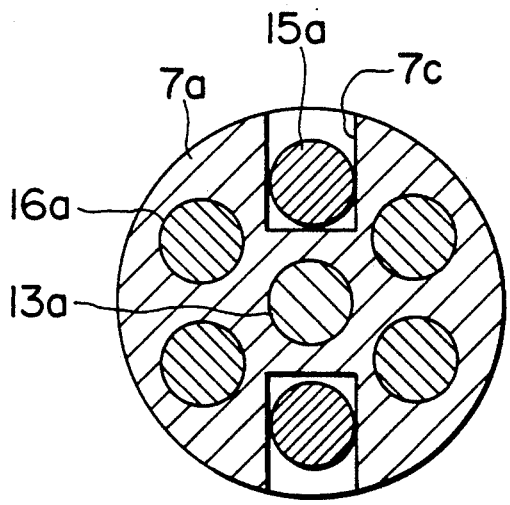
FIG. 2 is a cross-sectional view taken along the line II—II of FIG. 1.
Figure 3:
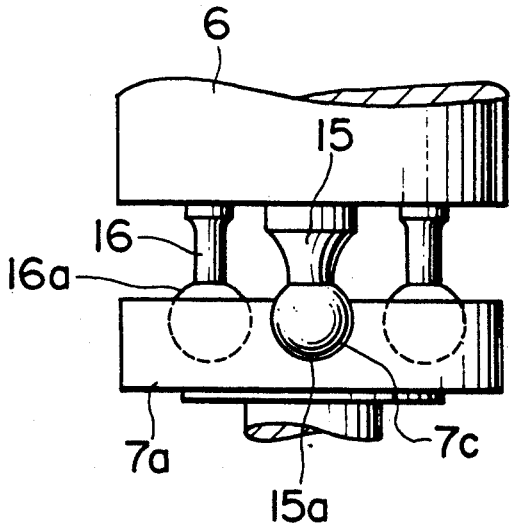
FIG. 3 is a top view of an essential portion of the piston pump apparatus shown in FIG. 1.

As illustrated in FIG. 2, the slide grooves 7c extend radially outwards in the piston support 7a. Furthermore, as shown in FIG. 3, each slide groove 7c is formed in a semi-circular cross-section which fits to the spherical head 15a of the corresponding drive piston 15. The spherical head 15a of each drive piston 15 is placed and held in the corresponding slide groove 7c to rotate together with the piston support 7a. In this state, each of the spherical heads 15a is rotatable and radially slidable with respect to the piston support 7a although it is restrained from axially moving.

Incidentally, the structure for supporting the drive pistons may be the same with that of a universal joint which has been disclosed in U.S. Pat. No. 4,894,045 (corresponding to Japanese Patent Unexamined Publication No. 63(1988)-308220) to the inventors on Jan. 16, 1990. The disclosure of this patent is hereby totally incorporated herein by reference.

Reference numeral 16 indicates other pistons disposed in the remaining cylinder bores 6a. Each of the pistons 16 has one end for sliding in the corresponding cylinder bore 6a, and the other end which projects from the cylinder bore 6a and is formed with a spherical head 16a. Each piston has a seal ring 17 attached to its one end, and the outer circumferential surface of the one end which contacts the wall of the cylinder bore 6a is formed in a spherical shape as a whole. The intermediate portion between these ends of each piston 16 is formed to have a diameter sufficiently smaller than the inner diameter of the corresponding cylinder bore 6a. Thus, each of the pistons 16 is pivotable with respect to the corresponding cylinder bore 6a with the circumferential surface of its one end kept in contact with the wall of the cylinder bore 6a. The piston support 7a of the drive shaft 7 is provided at corresponding positions to these pistons 16 with semi-spherical recesses for holding the spherical heads 16a of respective pistons. The spherical heads 16a of the pistons are attached in these recesses so that they are restrained from axially moving although pivotable.

When the drive shaft 7 rotates in the piston pump of the structure described above, the torque of the shaft is transmitted to the cylinder barrel 6 through the piston support 7a and the drive pistons 15. The cylinder barrel 6 is synchronously rotated by the torque thus transmitted, and the pistons 16 are rotated together. At this time, the piston support 7a which is inclined to the cylinder barrel 6 effects pivotal movement with respect to the cylinder barrel 6. The pistons 15 and 16 respectively make reciprocal movement to the cylinder barrel 6 since they are held at their spherical heads 15a and 16a onto the piston support 7a. The piston support 7a, the end cover 2, etc. are arranged so that the pistons 15 and 16 are reciprocally moved in response to the communication of the respective cylinder bores 6a with the suction hole 2a or the discharge hole 26. In this manner, suction/discharging of a fluid is achieved by the reciprocal movement of the piston 15 or 16 in each of the cylinder bores 6a.

When the inclination angle $\theta$ of the piston support 7a is varied during the operation of the pump, a difference is caused between a pitch circle of the cylinder bores 6a and a pitch circle of the spherical heads 15a of the pistons 15. In this case, each of the drive pistons 15 absorbs this difference through the displacement of its spherical head 15a along the corresponding slide groove 7c of the piston support 7a in a radial direction of the pitch circle. Thus, the shank portions of the drive pistons 15 are securely brought in surface contact with the respective cylinder bores 6a without inclining to the latter, so that the pistons 15 fulfill their inherent piston function and smoothly transmit driving force from the drive shaft 7 to the cylinder barrel 6. On the other hand, each of the pistons 16 absorbs the above difference through the rotation of its one end or piston head with respect to the corresponding cylinder bore 6a although the piston inclines to the cylinder bore 6a. In this event, the pistons 16 do not impinge upon the walls of the respective cylinder bores 6a since the pistons 16 have each the reduced diameter at their intermediate portions.

The pump apparatus of this embodiment is of a high pressure variable displacement or delivery type, and the inclination of the piston support 7a with respect to the cylinder barrel 6 varies when the drive shaft 7 is moved laterally in FIG. 1. Each of the pistons changes in its reciprocal stroke depending on this inclination, thus varying its delivery or displacement. In this embodiment, a stopper 3a is provided in the through hole at the bottom of the housing 3 and limits the inclination of the slide block 10° to 20° at maximum when coming into contact with the lower projection of the slide block 10.

According to this embodiment, excessive forces exerted on the respective spherical heads of the pistons are smoothly absorbed to thereby reduce mechanical vibration although the pistons make elliptical movement during the operation. As some of the pistons also serve as drive pins, the pump structure does not become complicated nor unnecessarily large sized. Thus, it is possible to provide a compact and high powered pump apparatus at a relatively small cost.

Figure 4:
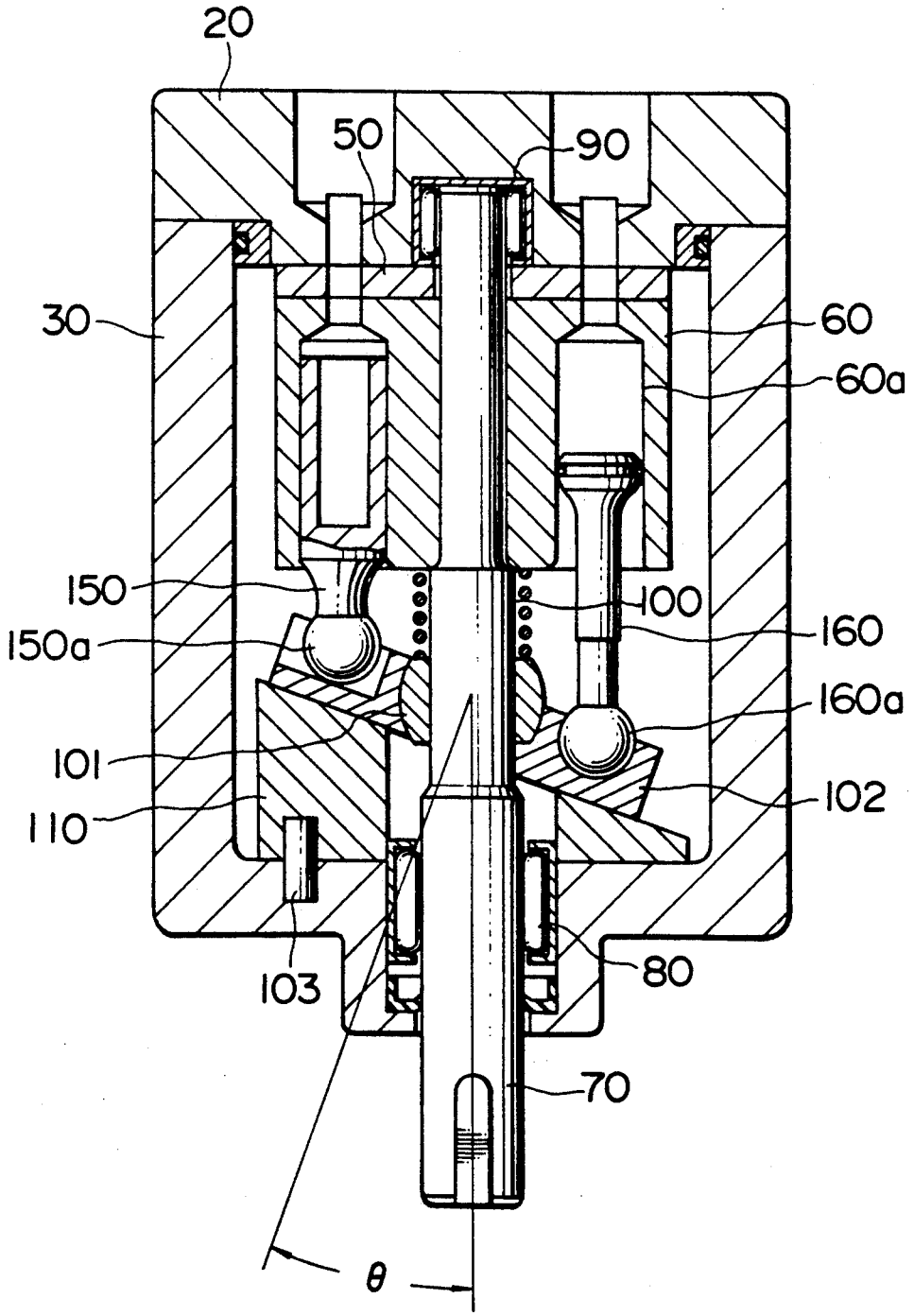
FIG. 4 is a longitudinal sectional view of a swash plate type axial piston pump apparatus according to another embodiment of the invention.

A low pressure axial piston pump apparatus according to the second embodiment of the invention will be described with reference to FIG. 4.

As in the first embodiment, the pump apparatus of this embodiment includes a substantially cup-shaped housing 30 with an open end which is closed with an end cover 20. A drive shaft 70 coaxially extends through the bottom of the housing 30 and is rotatably supported on that bottom and the end cover 20 through needle bearings 80 and 90. The needle bearing 80 is mounted so that part thereof projects from the bottom of the housing 30 into the latter.

Around one end of the drive shaft 70 a cylinder barrel 60 is mounted for rotation with the drive shaft 70. The cylinder barrel 60 contacts a valve plate 50 which is attached to the end cover 20. The cylinder barrel 60, the end cover 20 and the valve plate 50 are identical in structure to those of the first embodiment, respectively, and detailed description thereof is omitted.

A piston support 102 is mounted around a intermediate portion of the drive shaft 70 through a spherical bearing 101 for swing motion. The cylinder barrel 60 is provided with a plurality of cylinder bores 60*a* into which a pair of drive pistons 150 and other pistons 160 are slidably inserted. The drive pistons 150 and the pistons 160 are provided at their one ends with spherical heads 150*a* and 160*a*, respectively, which heads are received in the piston support 102. The pistons 150, 160 and the piston support 102 with slide grooves and recesses for supporting these pistons may be identical in structure to those of the first embodiment, respectively, and description thereof is omitted. A compression spring 100 is placed around the drive shaft 70 between the spherical bearing 101 and the cylinder barrel 60, so that the cylinder barrel 60 is always spring biased against the valve plate 50.

On the rear side of the piston support 102 there is provided a swash plate 110 which is a cylindrical member with a surface inclined at a predetermined angle $\theta$. The swash plate 110 is arranged so that the inclined surface thereof contacts the rear surface of the piston support 102, and thus the piston support 102 inclines to the cylinder barrel 60 at the angle $\theta$. The hollow portion of the swash plate 110 is so designed as to have an inner diameter which snugly fits around the outer periphery of the needle bearing 80 projecting from the bottom of the housing 30. The swash plate 110 is positioned on the bottom of the housing 30 by means of the needle bearing 80 and a positioning pin 103, and is fixed thereto with screws or the like (not shown).

In the pump apparatus of the above structure, the cylinder barrel 60 rotates together with the drive shaft 70 when the latter is driven. The torque or turning force of the cylinder barrel 60 is transmitted to the piston support 102 through the pair of drive pistons 150, so that the piston support 102 is synchronously rotated on the swash plate 110. As the piston support 102 rotates on the inclined surface of the swash plate 110, the pistons makes reciprocal movement within the respective cylinder bores 60*a* to effect suction/discharge.

The pump of the second embodiment is of a fixed displacement or delivery type, unlike the first embodiment, since the inclined surface of the swash plate 110 is set at the fixed angle. It is preferable to prepare several kinds of swash plates 110 which are different from each other in the inclination angle and to select the delivery amount of the pump by the replacement of the swash plate 110 according to a demand. In this case, as the delivery pressure of the pump may arbitrarily be changed from low pressure to high pressure with ease, the pump has an effect of increasing the range of its use.

According to the second embodiment, as in the preceding embodiment, the pistons, inclusive of the drive pistons, do not impinge upon the cylinder bores, and the drive pistons positively transmit torque. Thus, a low noise and small-sized low pressure pump can be provided with eases of fabrication and at a relatively low cost. Moreover, the positioning of the swash plate 110 is fairly easy since it is positioned with the help of the needle bearing 80, and this greatly facilitates assembly of the pump. Incidentally, the pump housing, as well as that of the first embodiment, may be generally made of a metallic material such as an aluminum alloy, but plastic materials may be used for reducing further the weight of the pump.

The present invention has been described on the basis of the embodiments, but it will be apparent that the present invention is not limited solely to these specific forms and can be made thereto various modifications or the invention may take other forms within the scope of the appended claims.

What is claimed is:

1. An axial piston pump apparatus comprising a drive shaft, a cylinder barrel rotatably arranged and having a plurality of cylinder bores formed therein and arranged in one circular row around and in parallel with an axis of rotation thereof, means for connecting said drive shaft with said cylinder barrel to rotate said cylinder barrel synchronously with said drive shaft, pistons slidable arranged within the respective cylinder bores, and piston support means mounted on said drive shaft for pivotally supporting one end of each of said pistons so that said one end of each of said pistons rotates synchronously with said cylinder barrel in a plane inclined with respect to said cylinder barrel, wherein two of said pistons in said one circular row are provided to be in surface contact with corresponding cylinder bores to serve as drive pins for transmitting torque between said cylinder barrel and said piston support means and wherein said piston support means includes two slide grooves such that said two pistons are radially slidable and axially restrained to smoothly transmit a driving force from said drive shaft to said cylinder barrel.

2. The apparatus according to claim 1, wherein said cylinder bores are provided in an odd number, and said two pistons are arranged at opposite positions with the axis of rotation of said cylinder barrel interposed therebetween.

3. The apparatus according to claim 1, wherein each of the other pistons than said two pistons is swingable with respect to the corresponding cylinder bore.

4. The apparatus according to claim 3, wherein each of the other pistons than said two pistons has one end which is formed in a spherical shape and which is rotatably held in a semi-spherical recess formed in said piston support means.

5. The apparatus according to claim 3, wherein each of the other pistons than said two pistons has another end which is formed at an outer circumferential surface thereof in a spherical shape as a whole to come into contact with an inner surface of the corresponding cylinder bore, and a portion between said one end and said other end of each of said other pistons is formed in a smaller configuration than the corresponding cylinder bore for preventing said portion from contacting the cylinder bore during swinging motion of each of said other pistons.

6. The apparatus according to claim 1, wherein each of said two pistons is formed at a shank portion thereof in a cylindrical shape to be rotatable and slidable with respect to the corresponding cylinder bore, and said one end of each of said pistons serving as the drive pins is held radially movably in the piston support means, whereby said one end of each of said pistons serving as the drive pins moves radially in said piston support means in accordance with rotation of said piston support means to prevent inclination of said two pistons with respect to corresponding cylinder bores and maintain appropriate surface contact between said two pistons and the corresponding cylinder bores.

7. The apparatus according to claim 6, wherein said one end of each of said pistons serving as the drive pins is formed in a spherical shape, and is slidably and rotatably held in corresponding one of slide grooves which are formed in said piston support means and have a semi-spherical cross-section.

8. The apparatus according to claim 1, wherein said cylinder barrel is coaxially and slidably mounted on said drive shaft and receives torque from said drive shaft through said connection means to rotate together with said drive shaft, said piston support means is rotatably and swingable mounted on said drive shaft through a spherical bearing, and said two pistons transmit the torque from said cylinder barrel to said piston support means to thereby rotate said piston support means synchronously with said cylinder barrel.

9. The apparatus according to claim 8, wherein said cylinder barrel is received in a sealed casing, said drive shaft is rotatably supported on said casing through another bearing, a coil spring is arranged between said spherical bearing of said drive shaft and said cylinder barrel to press said cylinder barrel toward said casing through a valve plate.

10. The apparatus according to claim 9, wherein said piston support means is inclined with respect to said cylinder barrel through contact of said support means with a swash plate which has a surface inclined at a fixed angle.

11. The apparatus according to claim 10, wherein said swash plate is arranged on opposite side of said piston support means to said cylinder barrel, and said piston support means is adapted to rotate on said inclined surface of said swash plate.

12. The apparatus according to claim 10, wherein said swash plate is fixed onto said casing.

13. The apparatus according to claim 10, wherein said swash plate is formed in a cylindrical shape which includes a hollow portion at a center thereof, and said other bearing supporting said drive shaft on said casing is fitted into said hollow portion of said swash plate to be positioned in place on said casing.

* * * * *